US006409310B1

(12) United States Patent
Frenkel et al.

(10) Patent No.: US 6,409,310 B1
(45) Date of Patent: Jun. 25, 2002

(54) INK-JET PRINT HEAD

(75) Inventors: Moshe Frenkel, Jerusalem; Joseph Kaplan, Rishon Lezion, both of (IL)

(73) Assignee: Idanit Technologies Ltd., Rishon Lezion (IL)

( * ) Notice: Subject to any disclaimer, the term of this patent is extended or adjusted under 35 U.S.C. 154(b) by 0 days.

(21) Appl. No.: 09/331,061

(22) PCT Filed: Dec. 30, 1997

(86) PCT No.: PCT/IL97/00437

§ 371 (c)(1),
(2), (4) Date: Jun. 16, 1999

(87) PCT Pub. No.: WO98/29252

PCT Pub. Date: Jul. 9, 1998

(30) Foreign Application Priority Data

Dec. 30, 1996 (IL) ..... 119944

(51) Int. Cl.[7] ..... B41J 2/04; B41J 2/05
(52) U.S. Cl. ..... 347/54; 347/63
(58) Field of Search ..... 347/54, 68, 69, 347/70, 71, 72, 50, 40, 20, 41–42, 63; 399/261; 361/700; 310/328–330; 29/890.1

(56) References Cited

U.S. PATENT DOCUMENTS

| | | | |
|---|---|---|---|
| 4,685,185 | A | 8/1987 | Boso et al. |
| 4,947,184 | A | 8/1990 | Moynihan |
| 4,972,204 | A | 11/1990 | Sexton |
| 5,221,934 | A | 6/1993 | Long |
| 5,426,458 | A | 6/1995 | Wenzel et al. |
| 5,448,273 | A | 9/1995 | Klein et al. |
| 5,559,540 | A | 9/1996 | Burolla |

FOREIGN PATENT DOCUMENTS

| | | |
|---|---|---|
| EP | 0 357 020 B1 | 7/1990 |
| WO | 89/07752 | 8/1989 |

OTHER PUBLICATIONS

Patent Abstracts of Japan; "Ink Jet Head"; Publication No. 61227063; Publication Date Sep. 10, 1986; Inventor: Uchiumi Kazuaki; App. No. 60069333; App. Date Feb. 4, 1985; NEC Corp.

Patent Abstracts of Japan: "Ink Jet Printer Head and Manufacturing Thereof"; Publication No. 08174848; Publication Date Sep. 7, 1996; Inventor: Tomita Kenji; App. No. 06322471; App. Date Sep. 26, 1994; Matsushita Electric Ind Co Ltd.

*Primary Examiner*—Raquel Yvette Gordon
(74) *Attorney, Agent, or Firm*—Nath & Associates PLLC; Gary M. Nath; Marvin C. Berkowitz

(57) ABSTRACT

An ink-jet print head suitable for use with pigment based inks having protective layers interdisposed between pairs of juxtaposed dissimilar metal surfaces having a relatively large electrochemical potential difference therebetween so as to substantially reduce the potential difference, thereby reducing clogging of the ink-jet nozzles. The ink-jet head further comprising a composite body formed with an array of ink jet nozzles for respectively emitting a train of ink droplets, each of said ink jet nozzles being associated with a piezoelectric transducer and adapted for flow communication with a source of pigment based ink via an ink duct.

5 Claims, 4 Drawing Sheets

INK-JET PRINT HEAD

FIELD OF THE INVENTION

The invention is generally in the field of ink jet print heads. In particular, the invention relates to ink jet print heads suitable for use with pigment based inks.

BACKGROUND OF THE INVENTION

Ink jet printing using dye based or hot melt inks is widely used for certain types of print runs, in particular, relatively short print runs of relatively large poster size prints. However, such inks are not suitable for billboard posters or other outdoor applications as they tend to fade rapidly.

Whilst the color fastness of pigment based inks is greater than that of dye based or hot melt inks, they have been found to rapidly clog ink jet nozzles of a conventional ink jet print head, thereby causing tell-tale white lines on a print of reduced quality.

Consequently, whilst desirable in terms of their color fastness, pigment based inks are not commonly used in ink jet printing applications to avoid the time consuming and expensive downtime required for cleaning purposes to ensure the printing of high quality prints.

SUMMARY OF THE INVENTION

The primary object of the present invention is to provide an ink jet print head suitable for use with pigment based inks.

A further object of the present invention is to adapt a conventional ink jet print head constituted by a composite body having parts of dissimilar metal hitherto adapted for use with dye based or hot melt inks so as to be suitable for use with pigment based inks.

In accordance with the teachings of the present invention, there is provided an ink jet print head suitable for use with pigment based inks, the ink jet print head comprising:

a composite body formed with an array of ink jet nozzles for respectively emitting a train of ink droplets, each of said ink jet nozzles being associated with a piezoelectric transducer and adapted for flow communication with a source of pigment based ink via an ink jet duct;

said composite body constituted by a plurality of constituent parts disposed substantially transverse to the direction of emission of a train of ink droplets, said composite body being made from two or more dissimilar metal parts of different electrochemical potential and thereby having one or more pairs of juxtaposed dissimilar metal surfaces each having a relatively large electrochemical potential difference thereacross;

at least one pair of juxtaposed dissimilar metal surfaces having a relatively substantial electrochemical potential thereacross have a protective layer interdisposed therebetween to at least substantially reduce said potential difference, characterized in that said composite body includes one or more aluminum parts each having a surface juxtaposed against a dissimilar metal surface, said aluminum parts having at least said surfaces coated, thereby reducing clogging of the ink jet nozzles of the ink jet print head when used with pigment based inks.

As shown in FIGS. 1 and 2, a conventional ink jet print head 1 for use with dye based or hot melt inks includes an aluminum housing 2 provided with an array of piezoelectric transducers 3, three stainless steel separator plates 4, 5 and 7, an aluminum chamber plate 8 and a nickel orifice plate 9 bonded together by adhesive to form a single sandwiched composite body 10 (see FIG. 2).

As shown, the ink jet print head 1 has an array of ink jet nozzles 11 each associated with a piezoelectric transducer 3 and in flow communication with an ink channel 13 via an ink jet duct 14, the ink channel 13 substantially extending along the length of the chamber plate 8 and adapted to be in flow communication with a source of pigment based ink (not shown).

Experimental work has shown that the hitherto occurring clogging of the ink jet nozzles of a conventional ink jet print head when used with pigment based inks can be substantially reduced by the provision of a protective layer between each pair of juxtaposed dissimilar metal surfaces.

On the basis of this experimental work, whilst the mechanism of the hitherto occurring clogging is not fully understood, it is believed that each pair of juxtaposed dissimilar metal surfaces in the composite body acts each pair juxtaposed dissimilar metal surfaces in the composite body acts as the plates of a Galvanic cell having a Galvanic current flow which facilitates the agglomeration of pigment particles in a pigment based ink.

It is known that aluminum, stainless steel and nickel have the following respective electrochemical potentials: −0.75V, −0.35V and −0.15V, and consequently, the composite body includes three Galvanic cells as follows:

(i) a Galvanic cell between the aluminum housing's front surface 2A and the stainless steel trailing separator plate's rear surface 4A, the Galvanic cell consequently having an electrochemical potential difference of 0.4V;

(ii) a Galvanic cell between the stainless steel leading separator plate's front surface 7A and the aluminum chamber plate's rear surface 8A, the Galvanic cell consequently having an electrochemical potential difference of 0.4V; and (iii) a Galvanic cell between the aluminum chamber plate's front surface 8B and the nickel orifice plate's rear surface 9A, the Galvanic cell consequently having an electrochemical potential difference of 0.6V.

In practice, the results of experimental work have indicated that a protective layer is required to preferably suppress a relatively large electrochemical potential difference across a pair of juxtaposed dissimilar metal surfaces or at least substantially reduce it to about 0.2V.

BRIEF DESCRIPTION OF THE DRAWINGS

For a better understanding of the invention and to show how the same may be carried out in practice, by way of non-limiting examples, reference will now be made to the accompanying drawings in which similar elements are likewise numbered and, in which.

DETAILED DESCRIPTION OF PREFERRED EMBODIMENTS

Figure 1:
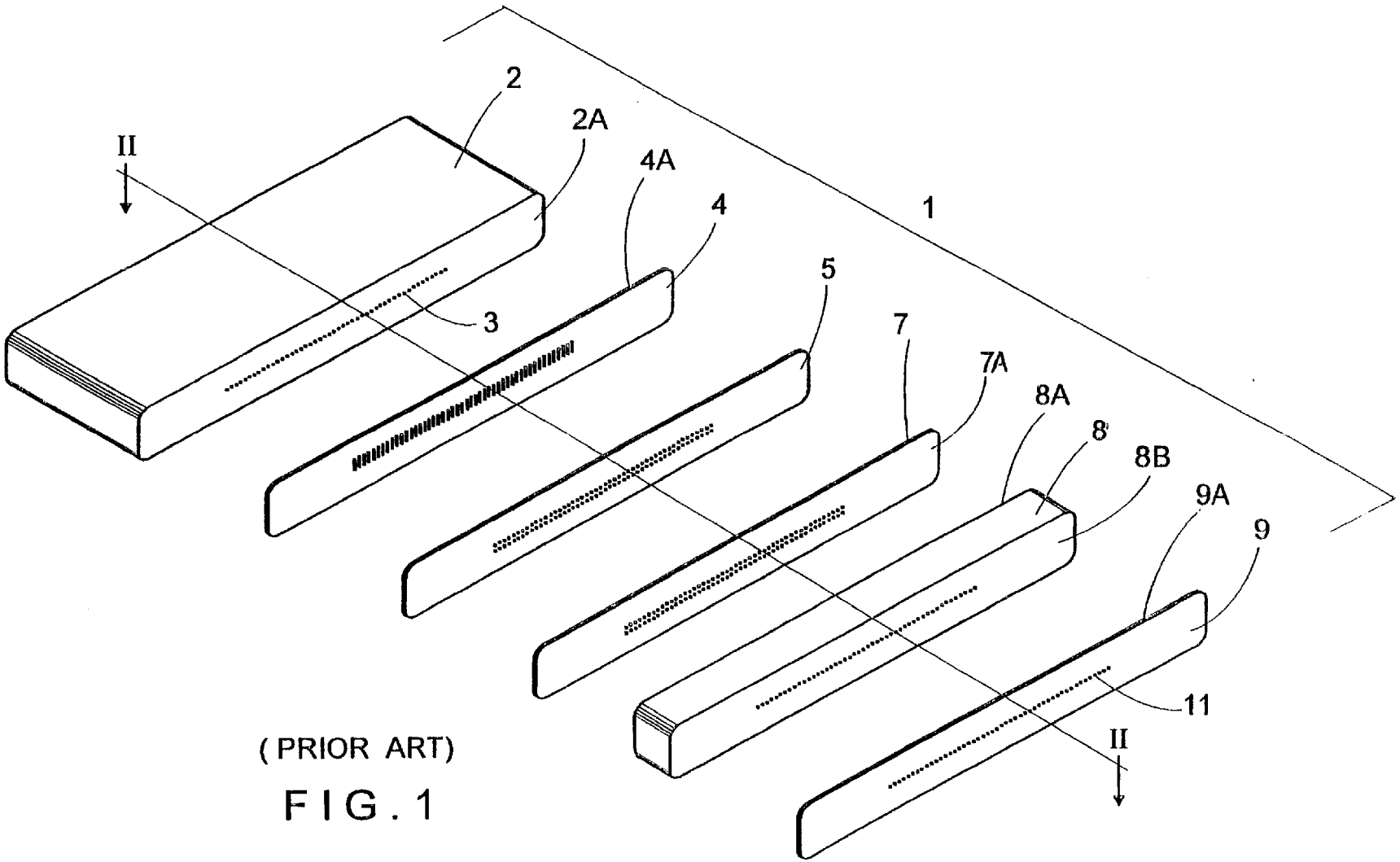
(PRIOR ART) FIG. 1
FIG. 1 is an exploded view of a conventional ink jet print head.
Figure 2:
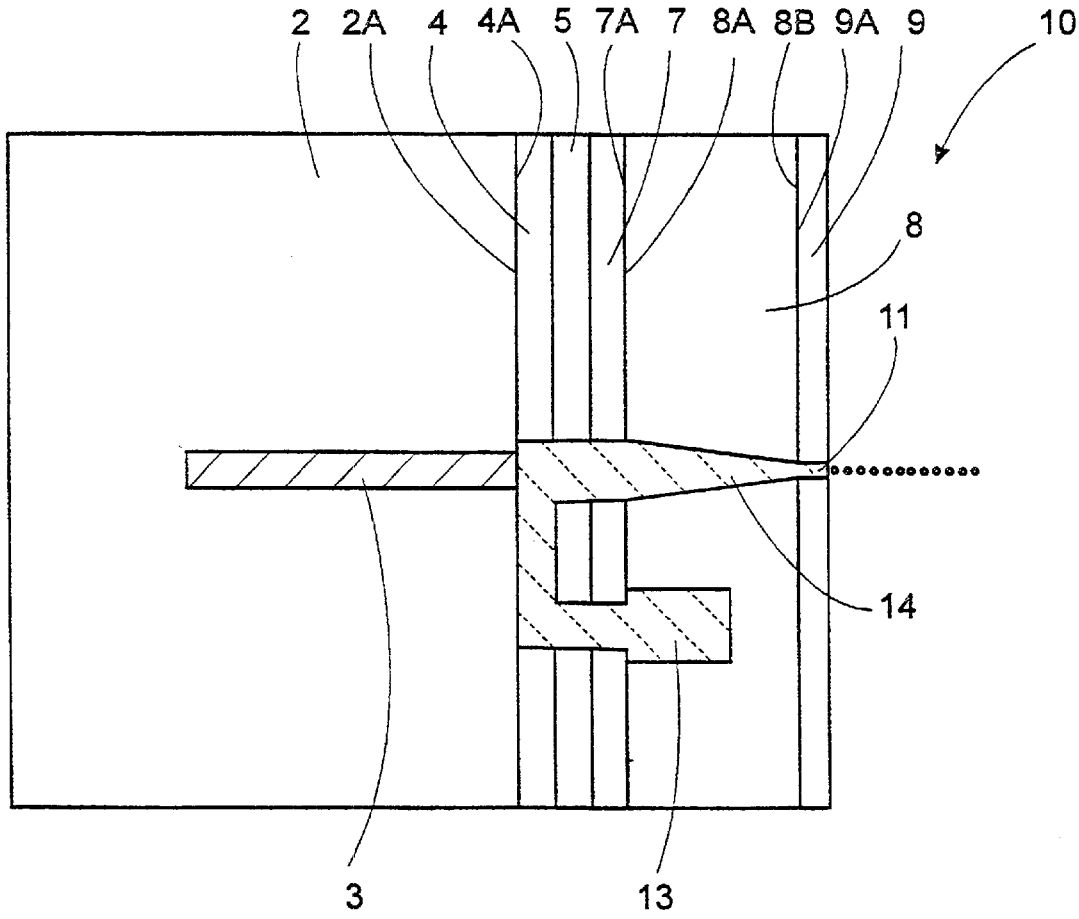
(PRIOR ART) FIG. 2
FIG. 2 is a cross-sectional view of an assembled conventional ink jet print head along line II—II in FIG. 1.
Figure 3:
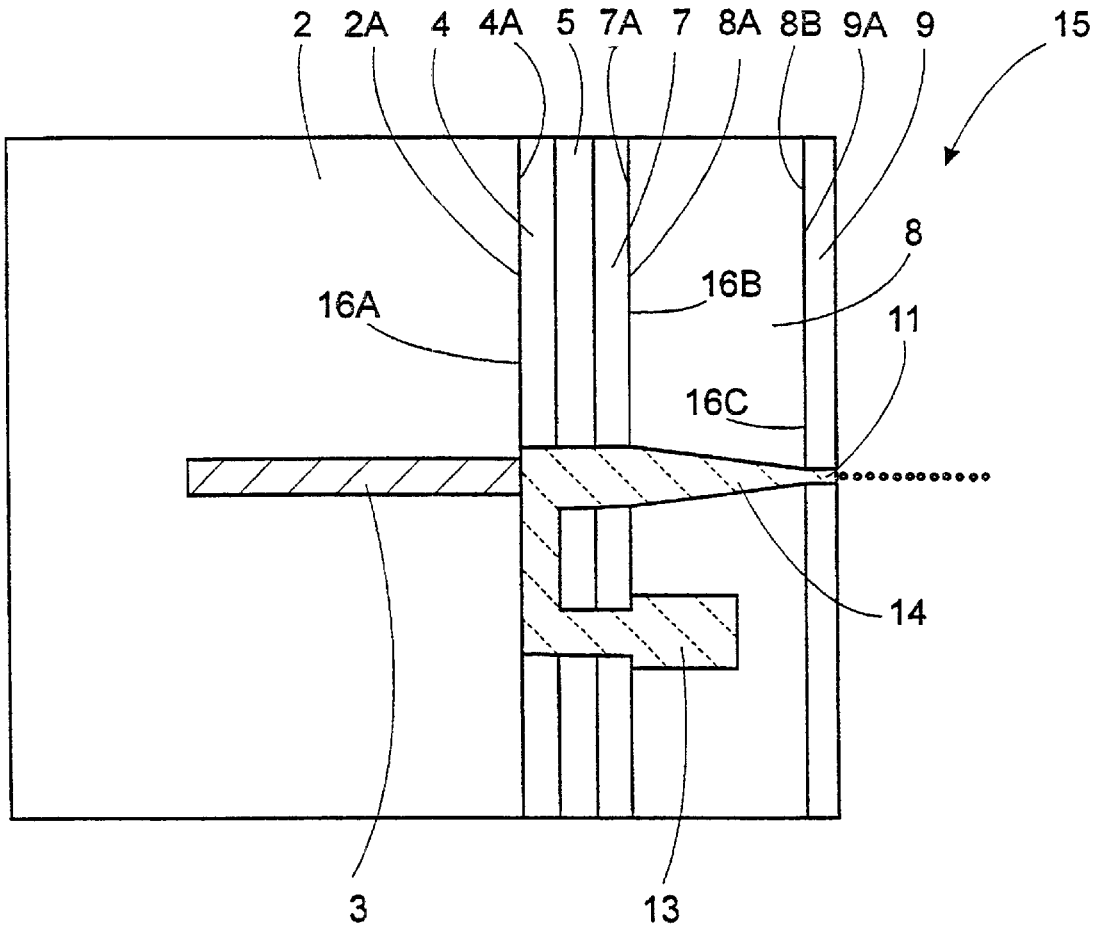
FIG. 3 is a cross-sectional view of an assembled ink jet print head suitable for use with pigment based inks in accordance with the present invention.

Turning now to FIG. 3, an ink jet print head 15 suitable for use with pigment based inks is similar to the conventional ink jet print head 1 except that it further includes a protective layer 16A interdisposed between the housing's front surface 2A and the trailing separator plate's rear surface 4A, a protective layer 16B interdisposed between the leading separator plate's front surface 7A and the chamber plate's rear surface 8A and a protective layer 16C interdisposed between the chamber plate's front surface 8B and the orifice plate's rear surface 9A.

The protective layers 16A, 16B and 16C are not necessarily the same and can each be constituted by a wide range of suitable materials. For example, the protective layer 16A can be constituted by an aluminum oxide coating formed when the entire surface area of the housing 2 is anodized whilst the protective layers 16B and 16C can be constituted by an aluminum oxide coating formed when the entire surface area of the chamber plate 8 is anodized. Since aluminum oxide is effectively an electrical insulator, suitably thick aluminum oxide protective layers 16A, 16B and 16C effectively suppress any hitherto occurring electrochemical potential differences.

Similarly, the protective layer 16A can be constituted by a nickel coating applied to the entire surface area of the housing 2 whilst the protective layers 16B and 16C can be constituted by a nickel coating applied to the entire surface area of the chamber plate 8. In this case, however, since a nickel coating is electrically conductive, suitably thick nickel coating protective layers 16A and 16B effectively reduce the Galvanic cells across the housing's front surface 2A and the trailing separator plate's rear surface 4A and across the leading separator plate's front surface 7A and the chamber plate's rear surface 8A to about 0.2V whilst a suitable thick nickel coating protective layer 16C effectively suppresses the hitherto occurring Galvanic cell across the chamber plate's front surface 8B and the orifice plate's rear surface 9A.

Still again, the protective layer 16A can be constituted by a polymeric coating applied to either the housing's front surface 2A or the trailing separator plate's rear surface 4A, the protective layer 16B can be constituted by a polymeric coating applied to either the leading separator plate's front surface 7A or the chamber plate's rear surface 8A and the protective layer 16C can be constituted by a polymeric coating applied to either the chamber plate's front surface 8B or the orifice plate's rear surface 9A. Polymeric coatings are typically electrical insulators and, therefore, polymeric coating protective layers 16A, 16B and 16C have the same effect as aluminum oxide protective layers.

Figure 4:
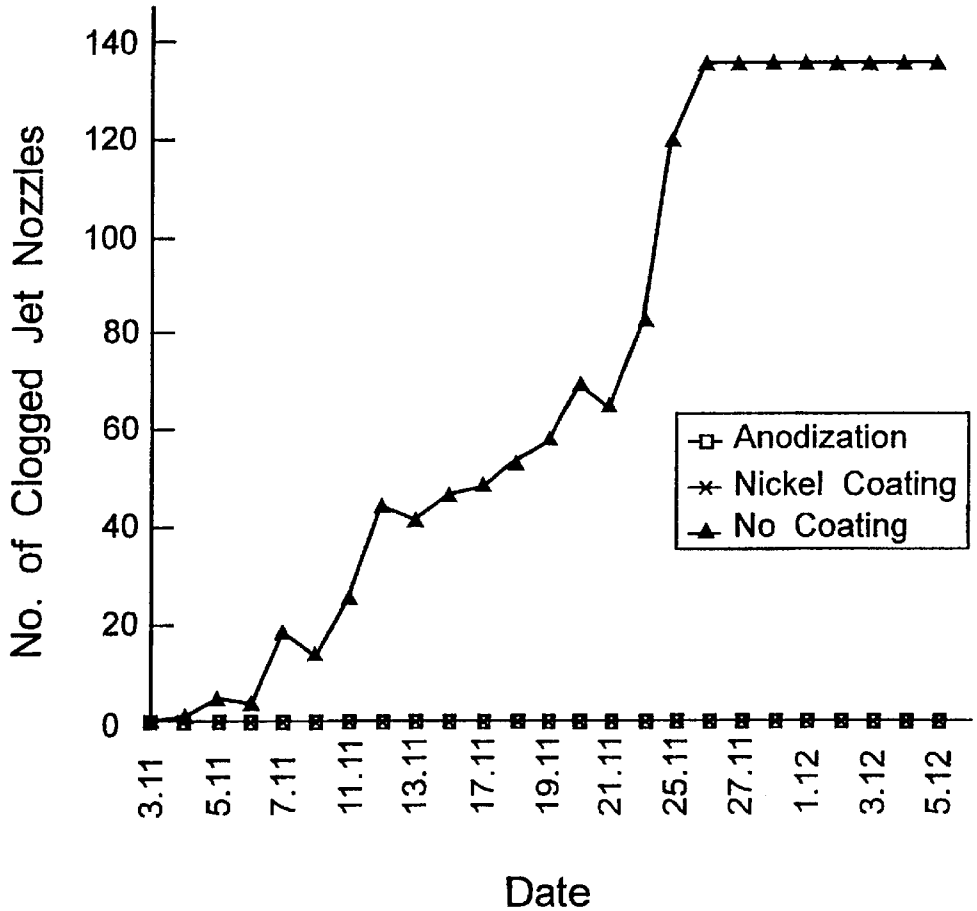
FIG. 4 is a graph showing the number of clogged ink jet nozzles against time for an ink jet print head before and after its modification in accordance with the present invention.

As shown graphically in FIG. 4 for aluminum oxide and nickel coating protective layers 16A, 16B and 16C, such protective layers help maintain a fully operational ink jet print head which otherwise would become rapidly clogged when used with a pigment based ink.

While the invention has been described with respect to a limited number of embodiments, it will be appreciated that many variations, modifications and other applications of the invention may be made.

What is claimed is:

1. An ink jet print head suitable for use with pigment based inks and adapted to be in flow communication with a source of pigment based ink, the ink jet print head comprising:

a composite body formed with an array of ink jet nozzles for respectively emitting a train of pigment based ink droplets, each of said ink jet nozzles being associated with a piezoelectric transducer and adapted for flow communication with the source of pigment based ink via an ink jet duct;

said composite body constituted by a plurality of constituent parts disposed substantially transverse to the direction of emission of a train of ink droplets, said composite body being made from two or more dissimilar metal parts of different electrochemical potential and thereby having one or more pairs of juxtaposed dissimilar metal surfaces each having a relatively large electrochemical potential difference thereacross;

at least one pair of juxtaposed dissimilar metal surfaces having a relatively substantial electrochemical potential thereacross has a protective layer interdisposed therebetween to at least substantially reduce said potential difference, characterized in that said composite body includes one or more aluminum parts each having a surface juxtaposed against a dissimilar metal surface, said aluminum parts having at least said surfaces coated, thereby reducing clogging of the ink jet nozzles of the ink jet print head when used with pigment based inks.

2. The ink jet print head according to claim 1 wherein said aluminum parts are coated by aluminum oxide.

3. The ink jet print head according to claim 1 wherein said aluminum parts are coated by a metallic coating.

4. The ink jet print head according to claim 3 wherein said metallic coating is nickel.

5. The ink jet print head according to claim 1 wherein said aluminum parts are coated by a polymeric coating.

* * * * *